United States Patent [19]

Thomas

[11] Patent Number: 4,840,586

[45] Date of Patent: Jun. 20, 1989

[54] KEYING APPARATUS FOR CONNECTING A PRINTED WIRING ASSEMBLY TO A BACKPLANE STRUCTURE

[75] Inventor: Sherman G. Thomas, Earlysville, Va.

[73] Assignee: General Electric Company, Charlottesville, Va.

[21] Appl. No.: 135,799

[22] Filed: Dec. 21, 1987

[51] Int. Cl.[4] ..... H01R 13/639

[52] U.S. Cl. ..... 439/680; 439/677

[58] Field of Search ..... 439/677, 680, 62, 64

[56] References Cited

U.S. PATENT DOCUMENTS

| | | | |
|---|---|---|---|
| 3,930,706 | 1/1976 | Obuch et al. | 439/677 X |
| 4,157,785 | 6/1979 | Freliech | 439/677 X |
| 4,568,134 | 2/1986 | DiMondi | 439/680 X |
| 4,693,532 | 9/1987 | Colleran et al. | 439/677 X |
| 4,695,112 | 9/1987 | Maston et al. | 439/680 X |

*Primary Examiner*—William L. Sikes
*Assistant Examiner*—Akm E. Ullah
*Attorney, Agent, or Firm*—Ormand R. Austin

[57] ABSTRACT

A keying apparatus is provided including a key support structure having a plurality of protrusions which mate with a corresponding plurality of recesses formed in an edge surface of a printed wiring assembly. The key support structure includes a mechanism for permanently latching the key support structure at a predetermined location on a mounting rail adjacent a backplane interconnect. The printed wiring assembly is conveniently removable from the key support structure. This keying apparatus assures that when a printed wiring assembly is removed from the key support structure at a predetermined location on the rail, only the proper printed wiring assembly may be reinserted at that location.

8 Claims, 2 Drawing Sheets

KEYING APPARATUS FOR CONNECTING A PRINTED WIRING ASSEMBLY TO A BACKPLANE STRUCTURE

BACKGROUND OF THE INVENTION

This invention relates in general to mechanical interconnections between mechanical receptacles and substrates with electrical circuits situated thereon. More particularly, the invention involves a keying arrangement for controlling connection of a printed wiring assembly or a similar structure to a specific receptacle in a backplane structure.

In modern electronics, it has become commonplace to interconnect several printed wiring boards or assemblies or printed circuit cards through a common interconnection board or wiring assembly generally referred to as a backplane. Typically each printed wiring board is mounted perpendicular to the backplane within a card rack. For example, contemporary programmable logic controllers employ a backplane having a plurality of parallel female multi-pin DIN or similar type electrical connectors. Each backplane connector is adapted to receive a mating male connector situated on an edge of a respective printed wiring board.

In general, each female connector is uniquely wired or software configured to provide proper circuit interconnection to a specific type of the printed wiring boards (PWB). If the wrong PWB type is inserted into one of the backplane connectors, at best the system may not work and in a worst case may result in significant electrical circuit destruction. For that reason, the DIN connectors are often "keyed" to prevent improper or incompatible connection. However, it is known that such keying of connectors per se has often been ineffective and requires unique keying of individual connectors on replacement PWB's.

BRIEF SUMMARY OF THE INVENTION

One object of the present invention is to provide an apparatus which prevents insertion or connection of an incorrect printed wiring board to a backplane. A more specific object is to provide a keying apparatus and method which uniquely keys a PWB type to an assigned PWB connector.

Another object of the present invention is to provide a keying apparatus wherein the initial insertion of the printed wiring assembly into a rail slot keys the slot to prevent future inadvertent replacement of the printed wiring assembly with an improper printed wiring assembly.

In one embodiment of the invention, a keying arrangement is provided for connecting a circuit board, for example a printed wiring assembly, to a backplane structure. The keying arrangement includes a backplane structure and further includes a circuit board with an edge surface and a key portion having a plurality of spaced apart recesses situated in the edge surface. A key support member is adapted to receive the key portion of the circuit board therein and to mate with the plurality of spaced apart recesses in the key portion. The keying arrangement further includes a mechanical attachment structure, situated on the key support member, for attaching the key support member to the backplane structure.

BRIEF DESCRIPTION OF THE DRAWINGS

The features of the invention believed to be novel are specifically set forth in the appended claims. However, the invention itself, both as to its structure and method of operation, may best be understood by referring to the following description and the accompanying drawings in which:

DETAILED DESCRIPTION OF THE INVENTION

Figure 1:
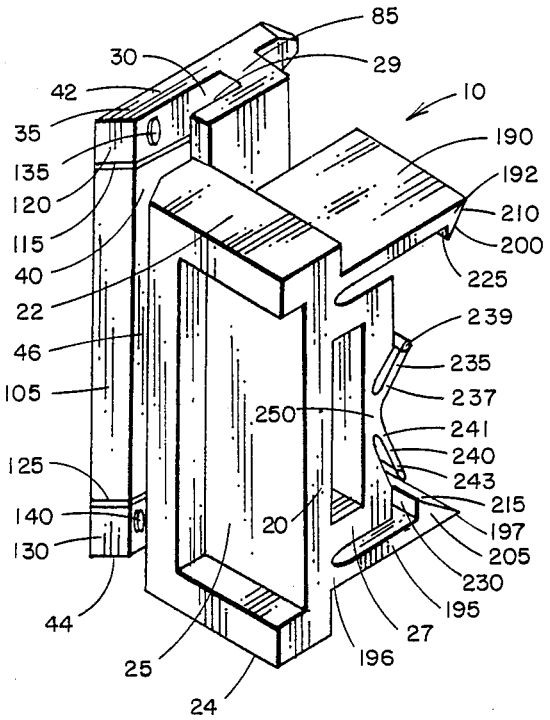
FIG. 1 is a front perspective view of the key support structure of the invention.
Figure 2:
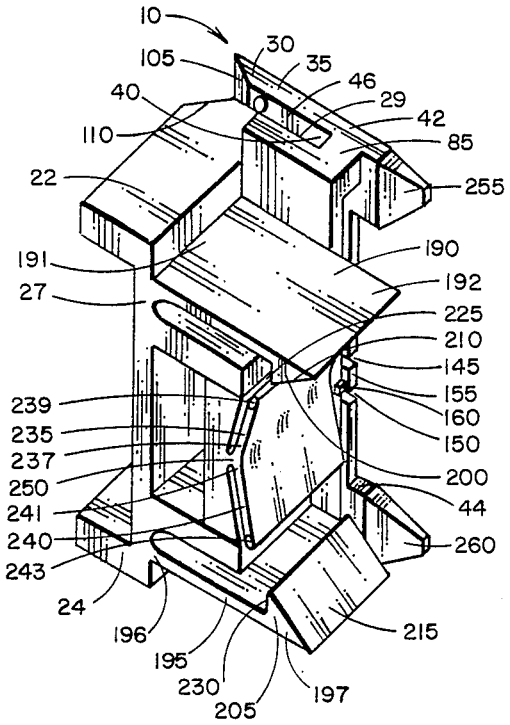
FIG. 2 is a side perspective view of the key support structure of the invention.

Turning now to FIGS. 1 and 2, there is illustrated, respectively, a front perspective view and a rear perspective view of one embodiment of a key support structure 10 according to the present invention. Key support structure 10 includes a main body 20 molded or otherwise formed from electrically insulative material such as plastic material. Main body 20 includes a top 22 and a bottom 24. Main body 20 further includes a front surface 25 and opposed side surfaces 27 and 29.

A key receiving portion 30 is situated adjacent to side surface 29 as shown in FIG. 1 and in the side perspective view of key support structure 10 in FIG. 2. Key receiving portion 30 includes a side member 35 having a substantially planar surface 40 facing and substantially parallel with side surface 29 of main body 20. Key receiving portion 30 further includes a top 42 and a bottom 44. Surfaces 29 and 40 are spaced sufficiently far apart to form an opening 46 capable of receiving a keyed printed wiring board.

Figure 3:
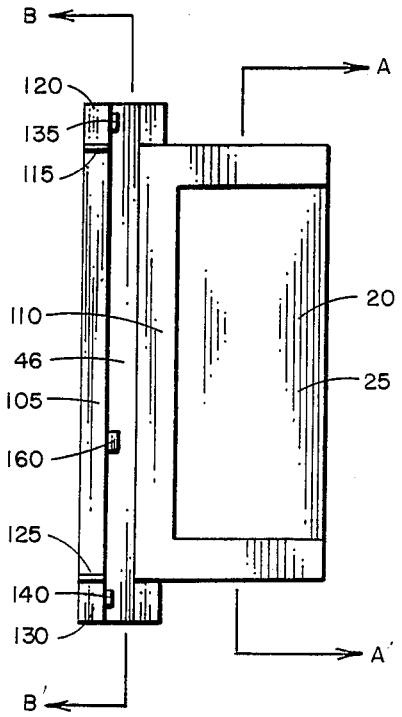
FIG. 3 is a front view of the key support structure of FIGS. 1 and 2.
Figure 4:
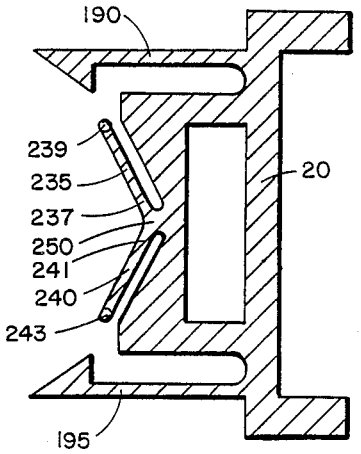
FIG. 4 is a cross section of the key support structure of FIG. 3 along section line A—A'.
Figure 6:
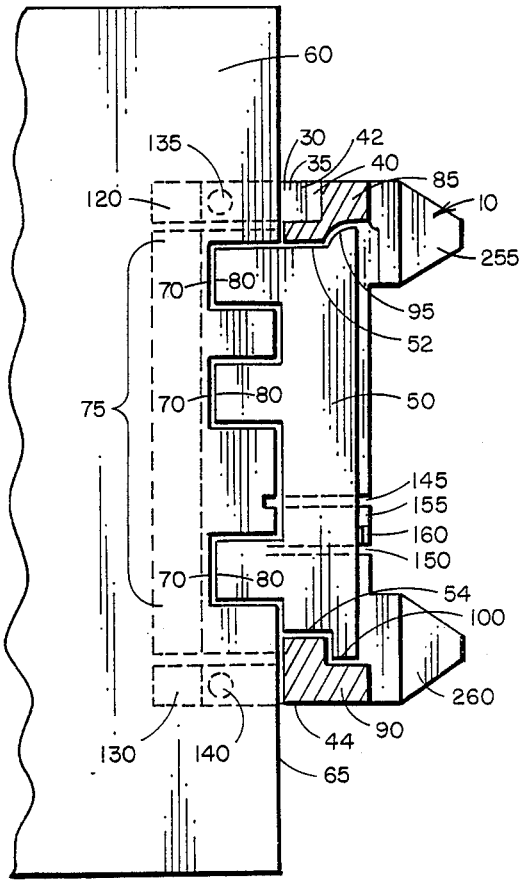
FIG. 6 is a representation of a keyed printed wiring assembly shown mated with a key mating member situated in the key support structure of FIG. 1.
Figure 5:
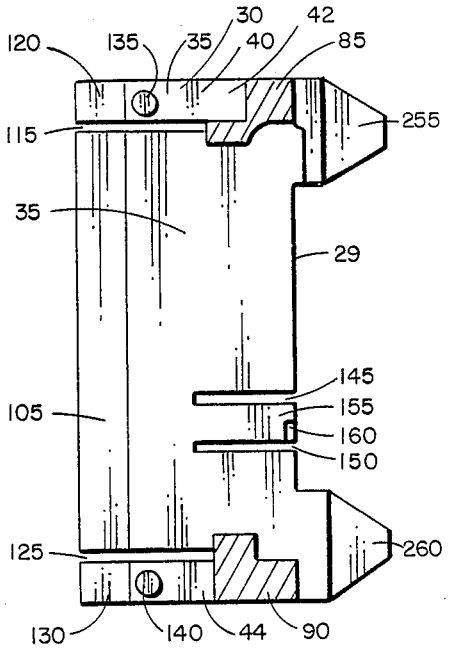
FIG. 5 is a cross section of the key support structure of FIG. 3 along section line B—B'.

FIG. 3 shows a front view of key support structure 10. A cross section of key support structure 10 taken along section line A—A is shown in FIG. 4. Another cross section of key support structure 10 taken along section line B—B is shown in FIG. 5. To more clearly illustrate the operation of the invention, FIG. 6 shows the key support structure 10 of FIG. 5 in actual use with a key mating member 50 and a keyed printed wiring assembly 60. Printed wiring assembly 60 is fabricated from conventional printed circuit board material. Although the term printed wiring assembly is used to describe assembly 60, in practice assembly 60 may be other electrical wiring board assemblies or cards wherein the intraboard connections are made by means other than printed circuit board techniques. Printed wiring assembly 60 includes an edge surface 65 into which a plurality of female recesses 70 are routed or otherwise formed. Spaces are provided between recesses 70 such that a key pattern is formed in edge surface 65. The portion of printed wiring assembly 60 which includes this key pattern is referred to as key portion 75.

A complementary key mating member 50 is situated within key support structure 10 for receiving key portion 75 therein as shown in FIG. 6. Key mating member 50 includes a top surface 52 and a bottom surface 54. Key mating member 50 is conveniently fabricated from the same printed wiring board material as printed wiring assembly 60 although other substrates of similar thickness and structural integrity could be used as well to fabricate key portion 75. Key mating member 50 includes a plurality of protrusions 80 for mating with the corresponding recesses 70. That is, for each recess 70 of key portion 75 on printed wiring assembly 60 there is a corresponding protrusion 80 in key mating member 50. Thus, only a printed wiring assembly 60 with a properly mating key portion 75 can be plugged into and mated with key mating member 50. In this manner, improper printed wiring assemblies are precluded from being plugged into key mating member 50 of key support structure 10. The widths of the respective protrusions 80 and recesses 70 may also be varied to provide keying of assembly 60 to key support structure 10. Furthermore, the relationship between recesses in the key portion and protrusions in the key mating member may be reversed so that protrusions extend from an edge surface of wiring assembly 60.

Once printed wiring assembly 60 is mated with key mating member 50, key support structure 10 is permanently mounted in a receiving rail in a card cage or other printed wiring assembly housing in a manner later described in more detail. When so mounted, printed wiring assembly 60 may be removed from key support structure 10, but key support structure 10 remains mounted in the rail waiting to receive printed wiring assembly 60 back when assembly 60 is reinserted on the rail.

It is noted that side member 35 is mechanically connected to main body 20 by a connecting member 85 at top 42 and by a connecting member 90 at the bottom 44 thereof as shown in the cross section of FIG. 6. Connecting member 85 is more clearly shown in the perspective view of key support 10 in FIG. 2. Returning again to FIG. 6, key mating member 50 includes a flange 95 in the top surface 52 thereof and a flange 100 in the bottom surface 54 thereof. Flanges 95 and 100 rest on connecting members 85 and 90, respectively, such that key mating portion 50 is held in place within key receiving portion 30.

Referring again momentarily to FIGS. 1 and 2, it is seen that key receiving portion 30 includes a beveled surface 105 for guiding printed wiring assembly 60 into opening 46. Side surface 29 of main body 20 includes a similar beveled surface 110 (see FIG. 2) which cooperates with beveled surface 105 to guide printed wiring assembly 60 into opening 46.

As shown in FIG. 5, the top 42 of side member 35 is provided with a horizontal slot 115 to form an arm 120. Similarly, the bottom 44 of side member 35 is provided with a horizontal slot 125 to form an arm 130. Arms 120 and 130 include respective raised portions 135 and 140 for engaging printed wiring assembly 60 when assembly 60 is inserted in key receiving portion 30 and mated with key mating member 50 as shown in FIG. 6. When assembly 60 is so inserted and mated, arms 120 and 130 exert a spring action which pushes raised portions 135 and 140, respectively, toward printed wiring assembly 60 to more snugly hold assembly 60 within opening 46 of key receiving portion 30, as may be visualized by considering FIGS. 1 and 6 together.

Referring now to FIG. 1 and in more detail to FIG. 5, it is seen that parallel horizontal slots 145 and 150 are molded, machined or otherwise formed in side surface 29. An arm 155 is thus formed between slots 145 and 150. A tab 160 is situated on arm 150 at the outer end thereof. As seen in FIG. 6, key mating member 50 rests against tab 160 and thus tab 160 helps hold key mating member 50 in place within key receiving portion 30.

Figure 7:
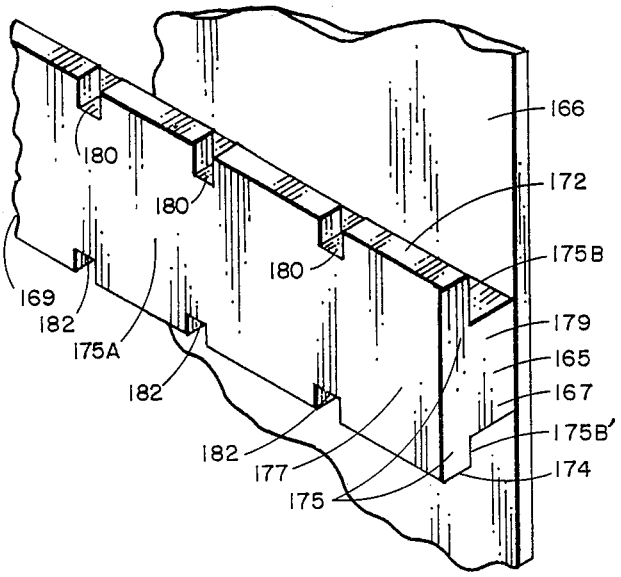
FIG. 7 is a representation of a rail structure for receiving the key support structure of FIG. 1.

FIG. 7 is a rail 165 for receiving a plurality of key support structures 10 and assemblies 60. Such rail 165 may be located within a card rack or other type of well known base structure for supporting and receiving one or more cards or printed wiring assemblies. Rail 165 is situated on backplane 166 and includes opposed ends 167 and 169. Rail 165 further comprised of a substantially T-shaped member extending between ends 167 and 169. Rail 165 includes a rectangularly-shaped bar member 175 and a cross member 179. Member 170 includes upper and lower edge portions 172 and 174, respectively. Bar member 175 includes an outer surface 175A. Bar member 175 further includes an upper inner surface 175B and a lower inner surface 175B' which are disposed on either side of cross member 179 as shown. A plurality of spaced-apart guide slots 180 are situated in upper side portion 172 of rectangularly-shaped member 175. A plurality of corresponding guide slots 182 are situated in lower side portion 174 of rectangularly-shaped member 175. That is, each upper guide slot 180 is vertically aligned with a corresponding lower guide slot 182.

Returning again to FIGS. 1 and 2, it is seen that prongs 190 and 195 connect to and extend away from main body 20. Prongs 190 and 195 include opposed ends 191, 192 and 196, 197, respectively. Prong ends 191 and 196 are attached to or are molded together with main body 20. Latch members 200 and 205 are situated at prong ends 192 and 197, respectively. In this embodiment of the invention, latch members 200 and 205 include beveled surfaces 210 and 215 which deflect apart when key support structure 10 is urged into contact with rail 175 of FIG. 7. Latch members 200 and 205 include ridges 225 and 230. Thus, when key support structure 10 is urged into contact with rail 175, beveled surfaces 210 and 215 are deflected apart until ridges 225 and 230 become latched on upper inner surface 175B and lower inner surface 175B' of rail 175.

Leaf spring members 235 and 240 are attached to main body 20 as shown in FIGS. 1 and 2 and as in the cross sectional view of key support structure 10 shown in FIG. 4. Spring member 235 includes opposed ends 237 and 239. Spring member 240 includes opposed ends 241 and 243. Spring ends 237 and 241 are connected via a common shank 250 to main body 20. When key support structure 10 is urged into contact with rail 175, leaf spring members 235 and 240 press against front surface 175A of rail 175. The spring action thus exerted by leaf spring members 235 and 240 aids in holding key support structure 10 in place on rail 175.

Key support structure 10 further includes guides 255 and 260 which are situated extending from the top 42 and the bottom 46, respectively, of key receiving portion 30 as shown most clearly in FIG. 2. Guides 255 and 260 point in a direction opposite opening 46. When key support structure 10 is mounted on rail 175 of receptacle 165 of FIG. 7, guides 255 and 260 fit in respective slots 180 and 182 in member 170. In this particular embodiment of the invention, guides 255 and 260 are exhibit a substantially pyramidal shape. Other geometries can be used for the shape of guides 255 and 260 as well, providing the shape of the guides becomes somewhat narrower on the side of the guide facing away from the main body 20 so as to be easily unsuitable in slots 180 and 182 of receptacle 165.

When key support structure 10 is latched in place with guides 255 and 260 being situated in slots 180 and 182, and with latch members 200 and 205 engaging rail 175, key support structure 10 is said to "substantially permanently" attached or latched to receptacle 165. By "substantially permanently" attached, it is meant that key support 10 is not easily removed from receptacle 165 without the aid of a tool or externally applied forces to pry latch members 200 and 205 apart. In this manner, the location on receptacle 165 where key support structure 10 is situated becomes permanently keyed such that only the proper mating printed wiring assembly 60 may be inserted at such location.

Figure 8:
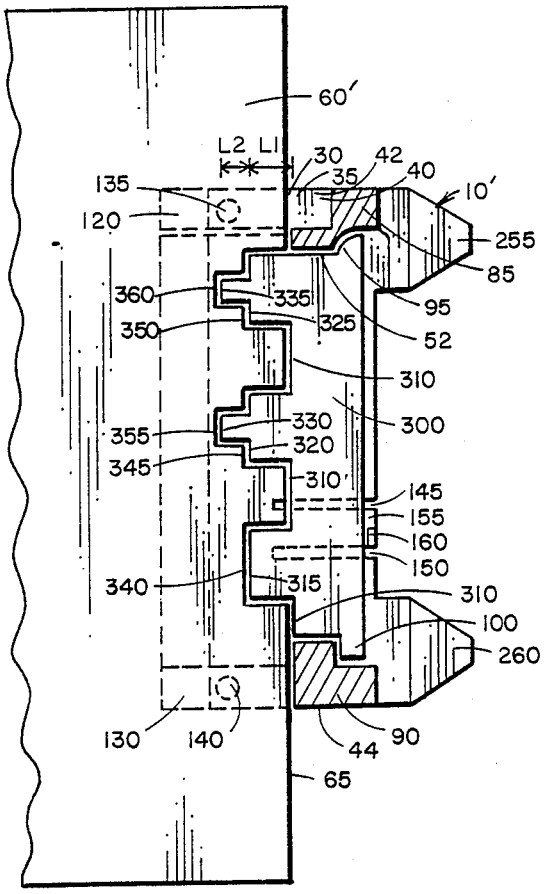
FIG. 8 is a representation of a keyed printed wiring assembly shown mated with another embodiment of the key mating structure of the invention.

FIG. 8 shows an alternative key support structure 10 which may be used to practice the invention. Key support structure 10 of FIG. 8 is identical to the key support structure 10 of FIG. 6 except for the shape of key mating member 300 which differs from key mating structure 50 of FIG. 6. In comparing the structures of FIG. 6 with those of FIG. 8, like numerals designate like elements. Key mating member 300 includes a reference surface or edge 310. A plurality of first protrusions, for example, protrusions 315, 320 and 325 extend beyond edge 310 by a distance Ll as shown in FIG. 8. At least one of protrusions 315, 320 and 325 includes a second smaller protrusion extending beyond the first protrusion by a distance L2 as shown. For example, in the embodiment of FIG. 8, first protrusions 320 and 325 include second protrusions 330 and 335, respectively. The second protrusions are substantially narrower than the first protrusions. To enable edge 65 of printed wiring assembly 60' to mate with key mating member 300, for each of the protrusions of key mating member 300, a corresponding recess is routed or otherwise formed in edge 65. That is, printed wiring assembly 60 includes first recesses 340, 345 and 350 formed to a depth L2 below edge 65 as shown to mate with first protrusions 315, 320 and 325, respectively. Second recesses 355 and 360 extend beyond recesses 345 and 350, respectively, by a distance L2. Second recesses 355 and 360 are substantially narrower than first recesses 340, 345 and 350, but are sufficiently wide to mate with protrusions 330 and 335, respectively. By providing a key mating member 300 of FIG. 8 with protrusions at first and second levels (L1 and L2) the number of possible "key combinations" is significantly increased over the single level key structure shown in FIG. 6.

To even further increase the number of key combinations possible when employing the keying apparatus of the invention, three or more levels of protrusions in key mating member 300 and corresponding recesses in printed wiring assembly 60 may be employed. Alternatively, in the keying structures of FIG. 6 or FIG. 8, the number of protrusions may be increased to provide more key combinations. Moreover, it will be appreciated instead of locating the protrusions in key mating member 300 and the recesses in the edge of assembly 60 , the protrusions could be located in assembly 60 with the mating recesses being situated in key mating member 300. This is regarded as an equivalent structure to that already discussed, although it may not be as convenient to fabricate.

The foregoing has described a keying apparatus for connecting a printed wiring assembly to a backplane structure. The key support structure of the invention assures that a printed wiring assembly is mounted at the proper location on the backplane and rail without the use of key tabs inserted in the backplane or terminal board. The present invention provides a keying apparatus in which the initial insertion of the printed wiring assembly and key support structure into a rail slot keys the slot to prevent future inadvertent replacement of the printed wiring assembly with an improper printed wiring assembly.

While only certain preferred features of the invention have been shown by way of illustration, many modifications and changes will occur to those skilled in the art. It is, therefore, to be understood that the present claims are intended to cover all such modifications and changes which fall within the true spirit of the invention.

I claim:

1. A keying arrangement for preventing insertion and connection of an incorrect circuit board connector in a multi-board card rack comprising:

a circuit board including an edge surface and a key portion having at least one unique recess situated along said edge surface;

a key mating member having at least one protrusion for precisely mating with said key portion;

key support means adapted to receive said key mating member and for positioning said key mating member for mating with said key portion; and mechanical attachment means, situated on said key support means, for attaching said key support member to said card rack.

2. The keying arrangement of claim 1 wherein said key portion has a plurality of spaced recesses along said edge surface, said key mating member having a corresponding plurality of protrusions for mating with said key portion.

3. The keying arrangement of claim 1 wherein said key support means includes attachment means for substantially permanently attaching said key support means to said card rack or base.

4. The keying arrangement of claim 3 wherein said card rack includes a plurality of parallel mounted circuit board connectors for electrically interconnecting a plurality of said circuit boards via a backplane, and including a receptacle means, situated adjacent said backplane, for receiving said attachment means therein.

5. The keying arrangement of claim 2 wherein said first protrusions exhibit a first predetermined width, at least one of said protrusions including a second protrusion extending therefrom and exhibiting a second predetermined width narrower than said first predetermined width, the recesses on said circuit board being shaped to mate with the first and second protrusions of said key portion receiving means.

6. A keying apparatus for connecting a circuit board to a backplane structure comprising:

a key portion having plurality of spaced apart recesses in an edge surface of said circuit board, said recesses penetrating said first key portion to first and second levels;

a key receiving portion having protrusions which mate with the recesses of said key portion; and mechanical connecting means, connected to said key receiving portion, for attaching said key portion receiving portion to said backplane.

7. A keying apparatus for connecting a circuit board to a backplane structure, said circuit board including an edge surface and a key portion having a plurality of spaced apart recesses situated in said edge surface, said keying apparatus comprising:

key support means, adapted to receive said key portion therein, for mating with the plurality of spaced apart recesses of said key portion; and mechanical connecting means, situated on said key support means, for attaching said key support member to said backplane.

8. A key support for use with a circuit board including a key portion exhibiting a predetermined geometric pattern, said key support comprising:

a main body;

mechanical connecting means, connected to said main body, for attaching said main body to a backplane structure;

a chamber, situated within said main body, adapted to receive the key portion of said circuit board therein, and a key mating structure, situated within said chamber, and exhibiting a geometric pattern which mates with the geometric pattern of said key portion.

* * * * *